United States Patent [19]

Self

[11] 4,243,178

[45] Jan. 6, 1981

[54] AIR GUN WITH SAFETY NOZZLE

[75] Inventor: Cecil H. Self, Lawndale, N.C.

[73] Assignee: John F. Schenck, III, Lawndale, N.C.

[21] Appl. No.: 12,658

[22] Filed: Feb. 16, 1979

[51] Int. Cl.[3] ..... B05B 9/01

[52] U.S. Cl. ..... 239/436; 15/405; 239/526; 239/DIG. 22

[58] Field of Search ..... 239/291, 436, 443, 450, 239/525, 526, 533.1, 586, DIG. 21, DIG. 22; 15/405

[56] References Cited

U.S. PATENT DOCUMENTS

| | | | |
|---|---|---|---|
| 3,263,934 | 8/1966 | Hope, Jr. et al. | 239/586 X |
| 3,599,876 | 8/1971 | Kyburg | 239/526 X |
| 3,897,003 | 7/1975 | Zehr | 239/291 X |

*Primary Examiner*—Andres Kashnikow

*Attorney, Agent, or Firm*—Bell, Seltzer, Park & Gibson

[57] ABSTRACT

An air gun adapted to deliver a directed stream of high pressure air for cleaning and which is characterized by the ability to transmit the compressed air during normal operation with negligible loss of air pressure between that admitted and that released. The air gun includes a safety nozzle which comprises a flow tube, through which the pressurized air flows during normal operation, and a surrounding sleeve that extends outwardly beyond the outlet end of the flow tube and terminates closely adjacent thereto so as to serve to protect against blockage or stoppage of the outlet end. The sleeve also includes exhaust apertures closely adjacent the outlet end so that in the event the discharge end of the sleeve is blocked or obstructed, the pressurized air will be released through the exhaust apertures and the air pressure at the discharge end significantly reduced.

13 Claims, 6 Drawing Figures

AIR GUN WITH SAFETY NOZZLE

FIELD OF THE INVENTION

The present invention relates to a device for delivering a directed stream of high pressure air for miscellaneous purposes such as cleaning and dusting of workpieces and work areas or the like. More specifically, the invention concerns an air gun which is capable under normal operating conditions of emitting a jet of compressed air at substantially the same pressure as delivered to the air gun, and which is provided with a safety nozzle adapted to significantly reduce the air pressure directed to its discharge end in the event the discharge end is blocked or obstructed.

BACKGROUND OF THE INVENTION

Compressed air is frequently used by workmen and others for purposes of cleaning or dusting the work areas, materials, or machines with which they are working. Typically, a source of pressurized air is tapped by the workman, and the compressed air is conveyed through flexible hoses to the work area. A manually operable air gun or some similar device is connected to the flexible hose so that the pressurized air can be selectively directed at the object requiring cleaning or dusting. The use of the compressed air in this manner provides an effective and efficient means for removing foreign and unnecessary material from the work area. When blown with the compressed air, small particles, dirt and other unwanted material tend to fly off of the targeted object so as to leave the work area relatively clean.

Workmen and others using compressed air for cleaning have also been known to engage in mischievous conduct which includes, among other practices, directing pressurized air at an individual. Particularly, injury has often resulted when the nozzle of an air gun is placed against the body of a person and pressurized air released from the gun. The high pressure air can penetrate the victim's skin, be admitted into his veins and blood vessels, and consequently result in serious injury and even death.

Partially as a result of the above circumstances, there has been promulgated under the Occupational Safety and Health Act a regulation that prohibits the use of compressed air for cleaning purposes except when reduced to less than 30 p.s.i. As explained in a later directive, the regulation was interpreted to mean that the downstream pressure of the air at the nozzle or opening of the air gun must be below 30 p.s.i. when the nozzle or opening is obstructed or dead ended. Thirty p.s.i. would not be sufficient pressure to result in injury to the victim when applied to his skin.

To meet these standards, there has previously been provided air guns which accept compressed air at a high pressure, but which deliver the compressed air within the 30 p.s.i. maximum limitation both during normal operation and when obstruction of the nozzle end occurs. Typically, this has been accomplished through the employment of certain structural features which either alone or in combination act to bleed off the pressurized air or allow for its commingling with ambient air. In each device, however, high pressure air, which is more desirable for cleaning, is not available.

For example, as illustrated in U.S. Pat. No. 3,263,934 to Hope, Jr., et al. and U.S. Pat. No. 3,129,892 to Tillman, air guns having nozzles with large expansion chambers have been proposed. Typically, the air gun includes an inner opening or orifice through which the pressurized air is emitted at a high velocity. Surrounding the orifice and projecting outwardly from the air gun body is positioned an outer tube within which is formed the expansion chamber and through which the stream of pressurized air must pass. Since the length of the expansion chamber between the orifice and the outlet of the outer tube is usually several times its diameter, the stream of compressed air is afforded a large volume into which it can expand. Consequently, the velocity of the compressed air between the orifice and the outlet end is severely reduced, diminishing the concentration of the directed stream of air and permitting substantial diffusion immediately upon exit of the compressed air from the outlet end.

Often in combination with the expansion chamber is included apertures or vent holes in the wall of the outer tube and forward of the orifice, as shown in the above noted patents to Hope, Jr., et al. and Tillman. The vent holes are provided for purposes of releasing the internal pressurized air in the event the outlet end is obstructed. However, the vent holes also have the effect of reducing the air pressure during normal operation prior to emission from the outlet end. Ambient air is drawn into the nozzle through the vent holes by the flow of the pressurized air through the outer tube. As the ambient air mixes with the pressurized air, the resulting usable air pressure is below that originally provided to the air gun.

Another method by which the air pressure is reduced before emission from the air gun is illustrated in U.S. Pat. No. 3,790,085 to Ayer and U.S. Pat. No. 3,599,876 to Kyburg. This design provides air passages which communicate with the flow of compressed air prior to emission of the compressed air from the inner opening or orifice of the air gun. These air passages are provided to prevent a build-up of air pressure in the nozzle in the event the outlet end of the nozzle is obstructed. Again, however, the air pressure provided originally to the air gun is not delivered to the work area. Pressurized air is allowed to escape through the air passages or ambient air is allowed to mix with the pressurized air so that even before the air reaches the orifice, the air pressure is lowered.

SUMMARY OF THE INVENTION

It is accordingly an object of the present invention to provide a device for delivering a directed stream of high pressure air for miscellaneous purposes such as cleaning and dusting of work areas and workpieces.

Another object of the present invention is to provide an air gun that is adapted to transmit compressed air from its source to the work area with negligible loss of air pressure. In this connection, it is also an object of this invention to provide a portable, manually operable air gun which delivers a high velocity, concentrated stream of air for cleaning or dusting, and which under normal operating conditions maintains substantially a constant air pressure between the input of compressed air to the air gun and the emission of a stream of air from the air gun.

It is a further object of the present invention to provide an air gun adapted to release pressurized air from the interior of its nozzle in the event the discharge end or outlet of the nozzle is blocked or obstructed. Under typical conditions of usage of the invention, it is an object to provide an air gun having an air outlet pressure not in excess of 30 p.s.i. when the discharge end or outlet is closed off by an obstruction.

These and other objects and advantages of the present invention are achieved in the embodiment illustrated herein by the provision of an air gun which includes a valve body having air inlet means adapted to be connected to a source of pressurized air and for admitting pressurized air to the valve body. The valve body also has air outlet means for degress of the pressurized air from the valve body, and a valve carried by the body is operably disposed between the inlet and outlet means. Mounted on the body is means for manual actuation of the valve so that the flow of pressurized air out of the body is selectively controlled.

An elongate, open-ended flow tube is supportingly carried by the valve body and extends outwardly therefrom. The flow tube includes respective inlet and outlet ends with the inlet end being in communication with the air outlet means of the valve body for receiving pressurized air. The outlet end is adapted to emit pressurized air in a directed stream from the air gun.

In a surrounding relation with respect to the flow tube, a sleeve is mounted and includes a discharge end which extends beyond the outlet end of the flow tube. The discharge end terminates closely adjacent the outlet end and thereby serves to protect against blockage or stoppage of the outlet end. The sleeve also includes exhaust means communicating with the interior of the sleeve and closely adjacent the oulet end of the flow tube. Under normal operating conditions, no material reduction in air pressure between the air inlet means and the discharge end will result, but if the discharge end is blocked or obstructed, pressurized air will be released through the exhaust means.

BRIEF DESCRIPTION OF THE DRAWINGS

Some of the objects and advantages of the invention having been stated, others will appear as the description proceeds, when taken in connection with the accompanying drawings, in which—

DESCRIPTION OF THE ILLUSTRATED EMBODIMENT

Figures 1, 2, 3, 4, 5, 6:
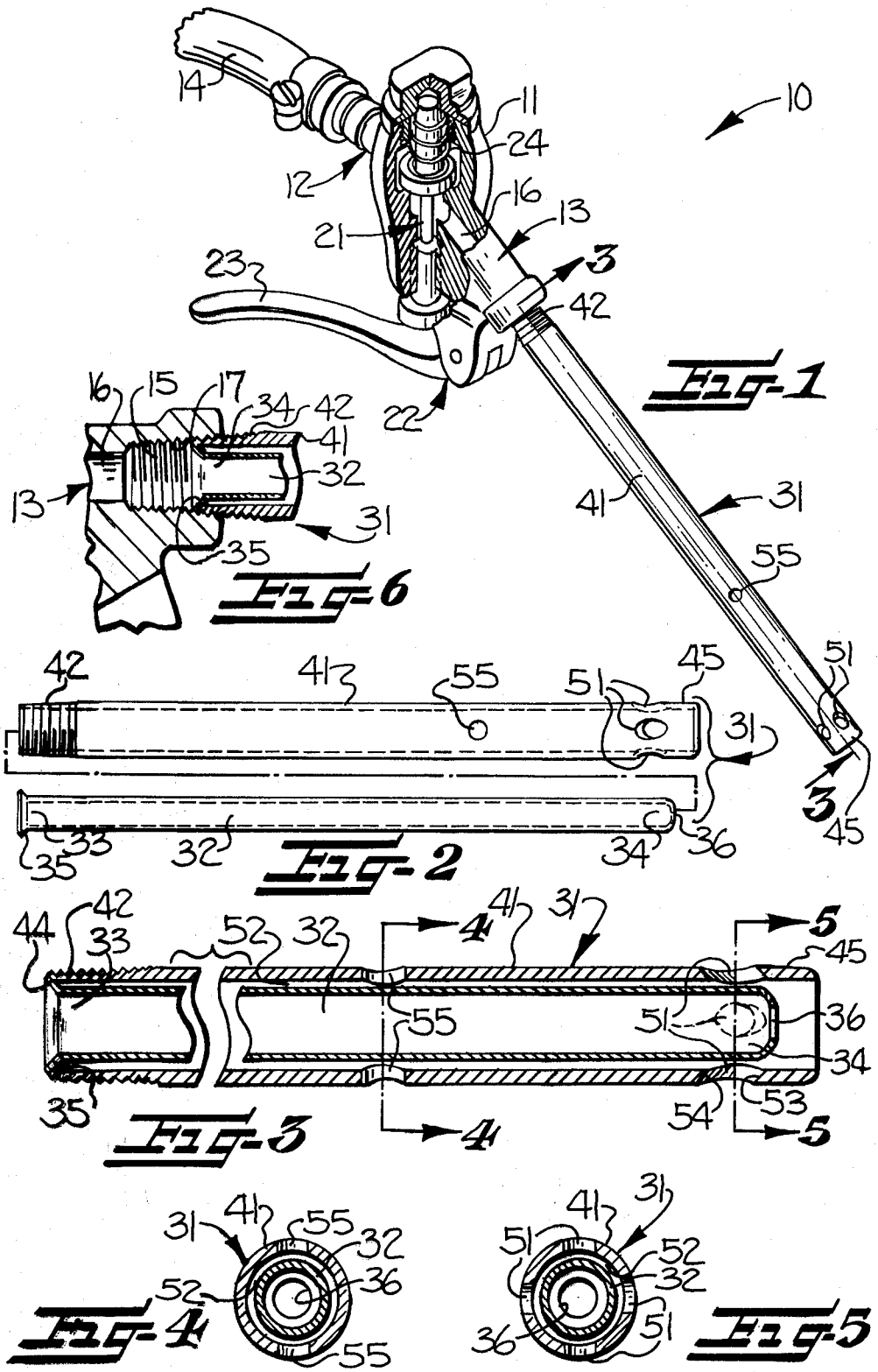
FIG. 1 is a perspective view of an air gun embodying the features of the present invention, and illustrating the valve body partially in section.
FIG. 2 is an exploded view of the nozzle of the air gun shown in FIG. 1.
FIG. 3 is a sectional side view of the air gun nozzle, and taken substantially along the line 3—3 of FIG. 1.
FIG. 4 is a sectional end view of the air gun nozzle, taken substantially along the line 4—4 of FIG. 3, and illustrating the position of the auxiliary exhaust apertures.
FIG. 5 is a sectional end view of the air gun nozzle, taken substantially along the line 5—5 of FIG. 3, and illustrating the position of the exhaust apertures.
FIG. 6 is a sectional view illustrating the nozzle mounted to the valve body.

Referring more specifically to the drawings, the illustrated embodiment of the air gun is indicated generally at 10 and will be seen to include a conventional, portable valve body 11 having air inlet means 12 and air outlet means 13. The air inlet means 12 is adapted to be connected to a source of pressurized air (not shown), and typically comprises a nipple, which is secured to a line or flexible hose 14 transmitting the compressed air, and an air passage interconnecting the interior of the nipple and substantially the center portion of the valve body 11. In this manner, the air inlet means 12 admits pressurized air to the body 11 by the physical flow of higher pressure air at its source to the lower pressure area within the valve body. An air pressure between 80 and 90 p.s.i. would typically be provided, and the valve body 11 is adapted to receive compressed air within this pressure range.

The air outlet means 13 of the valve body 11 is provided for egress of the pressurized air from the body and includes an air outlet chamber 15 opening outwardly from the body and an air passage 16 interconnecting the center portion of the body and the outlet chamber. The inner wall 17 of the outlet chamber 15 is threaded for purposes that will appear as the description proceeds.

Carried by the valve body 11 and positioned substantially within the center portion of the body is a valve 21 that is operably disposed between the inlet means 12 and outlet means 13. The valve 21, which is of a conventional design, controls the flow of pressurized air out of the body 11, and for that purpose, means 22 for manual actuation of the valve is mounted to the body. As illustrated in FIG. 1, the actuation means 22 includes a handle 23 pivotally mounted to the body 11 and having a surface which presses against the valve 21 when the handle is depressed to permit the emission of compressed air from the body. When the handle 23 is released, a spring 24 returns the valve 21 to its closed position wherein compressed air is not permitted to pass to the air outlet means 13. Thereby, the flow of compressed air from the valve body 11 can be selectively controlled to release a full or partial flow of compressed air or to inhibit the flow entirely.

The air gun 10 further comprises a nozzle 31 that is preferably formed from some rigid, metallic material and which includes an elongate open-ended flow tube 32. The outside diameter of the flow tube 32 is substantially uniform, and its overall length is proportionately several times greater than its diameter so that a slender, cylindrical nozzle is provided to facilitate the direction of pressurized air into work areas with difficult access. Preferably, the length of the flow tube 32 is about 5 inches and its diameter substantially less than 1 inch. In the specific embodiment illustrated, the flow tube 32 has an overall length of approximately 12.8 centimeters or 5 inches and a uniform outside diameter of approximately 0.6 centimeters or $\frac{1}{4}$ inch, thereby defining an extended flow tube of long and slender proportions.

The flow tube 32 is supportingly carried by the valve body 11 and extends outwardly in a direction which is convenient for an operator to simultaneously control the actuation means and direct the stream of compressed air. As illustrated in FIG. 3, the flow tube 32 has inlet and outlet ends 33 and 34 which are open to receive pressurized air and to emit pressurized air respectively. The inlet end 33 is in communication with the air outlet means 13 of the valve body 11, which supplies pressurized air to the flow tube 32. Furthermore, the inlet end 33 is outwardly flared, as indicated at 35 and as best shown in FIG. 3, and received in the air outlet chamber 15.

The oulet end 34 is adapted for emitting pressurized air in a directed stream from the air gun 10. In order to provide a directed stream of compressed air with minimal diffusion for a distance substantially beyond the outlet end 34, the outlet end is also adapted to maintain the pressurized air in the directed stream. Toward these ends, the outlet end 34 includes an outwardly directed opening 36 for emitting the pressurized air, and the cross sectional diameter of the opening 36 is smaller than the internal diameter of the flow tube 32. In the illustrated embodiment, the cross sectional diameter of the opening 36 is approximately 0.3 centimeters or ⅛ inch, and the inside diameter of the flow tube 32 is substantially uniform, being approximately 0.5 centimeters or 3/16 inch. The restricted opening 36 has the effect of increasing the velocity of the pressurized air as it is emitted from the flow tube 32. Thus, a concentrated stream of compressed air is formed and projects outwardly from the nozzle 31 when pressurized air is permitted to flow from the valve body 11 and through the flow tube 32.

The nozzle 31 also includes a sleeve 41 mounted in a surrounding relation with respect to the flow tube 32. While it is within the contemplation of the invention to secure the sleeve 41 to the flow tube 32 at any position rearward of the outlet end 34, it has been found to be convenient to mount the sleeve to the valve body 11 so that the sleeve projects outwardly from the body and coextensively with the flow tube. Thus, as illustrated in FIG. 6, a first end 42 of the sleeve 41 is mounted within the air outlet chamber 15, and is externally threaded to cooperate with the corresponding internal threads along the inner wall 17 of the chamber so as to be removably secured to the valve body 11.

The flow tube 32 is received within the sleeve 41 so as to be substantially in longitudinal alignment with the sleeve. As was discussed above concerning the flow tube 32, the sleeve 41 is also of long and slender proportions, which are capable of extending into narrow or restricted areas for cleaning or dusting, and preferably, the sleeve's length is about 5 inches, but somewhat longer than the flow tube, and the diameter substantially less than 1 inch. In the illustrated embodiment, the overall length of the sleeve 41 is approximately 13.3 centimeters or 5¼ inches and the outside diameter of the sleeve is approximately 1.1 centimeters or 7/16 inch. The inner diameter of the sleeve 41 is substantially uniform and is only somewhat greater than the outside diameter of the flow tube 32. Thus, in the illustrated embodiment, an inside diameter of approximately 0.8 centimeter or 5/16 inch is employed for the sleeve 41.

To support the flow tube 32 within the sleeve 41, the inlet end 33 of the flow tube includes an outward flare 35, as was previously noted, and has a diameter greater than the inside diameter of the sleeve, but less than the outside diameter of the sleeve. The first end 42 of the sleeve includes a shoulder 44 against which the flared inlet end 33 is supported when pressurized air passes through the flow tube 32. See FIG. 6. Since the outlet end 34 of the flow tube 32 is of a smaller diameter than the inlet end 33, a constant force urges the flow tube forward as compressed air flows through. In this forward position, the flare 35 of the flow tube 32 is held against the shoulder 44 and serves as a seal so that pressurized air is precluded from entering the first end 42 of the sleeve. Also in the forward position, the flow tube 32 projects outwardly in a cantilevered manner.

As noted earlier, the overall length of the sleeve 41 is greater than the length of the flow tube 32 and includes a second end 45 serving as a discharge which extends beyond the outlet end 34 of the flow tube and terminates closely adjacent the outlet end. Thus, the outlet end 34 is recessed within the sleeve 41 approximately 0.6 centimeter or ¼ inch in the illustrated embodiment. The projecting discharge end 45 thereby serves to protect against blockage or stoppage of the outlet end 34 of the flow tube 32, while the high velocity imparted to the compressed air by passing through the restricted opening 36 allows the stream of air to project a substantial distance beyond the nozzle 31. Under experimental conditions wherein 85 p.s.i. of compressed air was supplied to the air gun 10, tests showed approximately 85 p.s.i. of air pressure at the discharge end 45 of the sleeve. Therefore, under normal operating conditions, there is no material reduction in air pressure between the air inlet means 12 and the discharge end 45. Furthermore, there is no loss of compressed air, and the operator is provided with high pressure air which is more effective for cleaning and dusting.

The sleeve 41 also includes exhaust means communicating with the interior of the sleeve and closely adjacent the outlet end 34 of the flow tube 32 for releasing pressurized air from the interior of the nozzle 31 in the event the discharge end 45 of the sleeve is obstructed. As illustrated in FIG. 3, the exhaust means are shown in the form of a plurality of apertures 51 which are positioned on the sleeve 41 so that emission of the pressurized air is substantially entirely through the discharge end and so that diffusion of the directed stream of air prior to exit from the nozzle 31 is minimized. Particularly, the exhaust apertures 51 are positioned rearward of the outlet end 34 of the flow tube 32 where substantially no ambient air is drawn through the apertures 51 to commingle with the pressurized air. Consequently, there is no significant reduction in air pressure at the discharge end 45.

The flow tube 32 is positioned within the sleeve 41 so that the two are at least partially spaced from each other. As shown in FIGS. 4 and 5, the preferred design is to concentrically position the flow tube 32 with respect to the sleeve 41 so that a surrounding air passage 52 is formed between the outer wall of the flow tube and the inner wall of the sleeve. It should also be noted that the relative diameters of the flow tube 32 and sleeve 41 are such that the air passage 52 is proportionately narrow, being preferably about 1/16 inch in the illustrated embodiment. This also assists in limiting the ambient air admitted to the interior of the sleeve 41 forward of the flow tube 32.

In the event the discharge end 45 of the sleeve 41 is blocked or obstructed, the pressurized air can escape through the exhaust apertures 51 and from the interior of the nozzle 31. Thus, when the compressed air is emitted from the outlet end 34 and incurs the obstruction at the discharge end 45, the air is redirected rearward and is released through the exhaust apertures 51. For this purpose, four exhaust apertures 51 have been spaced circumferentially around the sleeve 41, and each aperture has a forward edge 53 that is angularly directed toward the outlet end 34. The rearward edge 54 of each aperture 51 may also be angularly oriented with respect to the length of the sleeve 41 so that when pressurized air is released through the apertures, the air is directed rearwardly and away from the discharge end 45.

Finally, the sleeve 41 also includes auxiliary exhaust apertures 55 to aid or assist in releasing pressurized air in the event of obstruction of the discharge end 45. Thus, the auxiliary apertures 55 communicate with the surrounding air passage 52 in the interior of the sleeve 41 and are positioned rearwardly of the exhaust apertures 51. As shown in FIGS. 3 and 4, two auxiliary apertures 55 are spaced diametrically opposite each other and within the middle portion of the sleeve 41.

Actual tests with the disclosed embodiment of the invention have demonstrated the efficacy of the exhaust apertures 51 and auxiliary exhaust apertures 55 for releasing pressurized air and reducing discharge end pressure in the event of an obstruction of the discharge end 45. With the discharge end dead ended or completely obstructed, a measurement of 24 p.s.i. at the discharge end was made when 85 p.s.i. was admitted to the air inlet means 12 of the air gun 10. These results illustrate satisfaction of the requirements for an effective and safe air gun, in that high pressure cleaning operations may be performed while OSHA safety requirements are met.

In the drawings and specification, there has been set forth a preferred embodiment of the invention, and although specific terms are employed, they are used in a generic sense only and not for purposes of limitation.

That which is claimed is:

1. In an air gun for delivering a directed stream of high pressure air, wherein there is provided a valve body having air inlet means adapted to be connected to a source of pressurized air and for admitting pressurized air to said body and having air outlet means for egress of the pressurized air from said body, a valve carried by said body and being operably disposed between said inlet means and said outlet means, and means mounted on said body for manual actuation of said valve so as to selectively control the flow of pressurized air out of said body, the combination therewith of an elongate open-ended flow tube supportingly carried by said valve body and extending outwardly therefrom, said flow tube having respective inlet and outlet ends, said inlet end being in communication with said air outlet means for receiving pressurized air therefrom and said outlet end being adapted for emitting pressurized air in a directed stream from said air gun; and a sleeve mounted in a surrounding relation with respect to said flow tube and having an inlet end and a discharge end extending beyond said outlet end of said flow tube and terminating closely adjacent thereto so as to serve to protect against blockage or stoppage of said outlet end, said sleeve including exhaust means communicating with the interior of said sleeve and closely adjacent the discharge end of the sleeve and remote from the inlet end thereof and also closely adjacent said outlet end of said flow tube so that under normal operating conditions no material reduction in air pressure between said air inlet means and said discharge end is effected, but in the event said discharge end is blocked or obstructed, pressurized air is released through said exhaust means.

2. In the combination as defined in claim 1 wherein said exhaust means comprises a plurality of apertures positioned on said sleeve entirely rearward of said outlet end of said flow tube and closely adjacent thereto.

3. In the combination as defined in claim 1 wherein said flow tube has a length proportionately several times greater than its diameter and providing an extended nozzle to facilitate the direction of pressurized air into work areas with difficult access.

4. In an air gun for delivering a directed stream of high pressure air, wherein there is provided a valve body having air inlet means adapted to be connected to a source of pressurized air and for admitting pressurized air to said body and having air outlet means for egress of the pressurized air from said body, a valve carried by said body and being operably disposed between said inlet means and said outlet means, and means mounted on said body for manual actuation of said valve so as to selectively control the flow of pressurized air out of said body, the combination therewith of a slender, cylindrical, rigid flow tube having substantially a uniform diameter and an overall length several times its diameter, said flow tube including an open inlet end supportably carried by said valve body so that said flow tube projects outwardly from said body in a cantilevered manner, said inlet end being in communication with said air outlet means whereby pressurized air is supplied to said flow tube, said flow tube further including an open outlet end for emitting pressurized air from said flow tube and for maintaining the pressurized air in a directed stream with minimal diffusion for a distance substantially beyond said outlet end; and a sleeve mounted to said valve body and projecting outwardly therefrom coextensively with said flow tube, said sleeve being positioned in a surrounding relation to said flow tube so as to be substantially in longitudinal alignment therewith and so as to be at least partially spaced therefrom, said sleeve having an overall length greater than the length of said flow tube and including an inlet end and a discharge end extending beyond said outlet end of said flow tube and terminating closely adjacent thereto so as to serve to protect against blockage or stoppage of said outlet end, said sleeve further including exhaust apertures communicating with the interior of the sleeve and spaced circumferentially around said sleeve closely adjacent the discharge end of the sleeve and remote from the inlet end thereof, and also clearly adjacent said outlet end of said flow tube so that under normal operating conditions no material reduction in air pressure between said air inlet means and said discharge end is effected, but in the event said discharge end is blocked or obstructed, pressurized air is released through said apertures.

5. In the combination as defined in claim 4 wherein said exhaust apertures are positioned rearward of said outlet end of said flow tube, each having a forward edge angularly directed toward said outlet end to facilitate the escape of pressurized air in the event of blockage of the discharge end of said sleeve.

6. In the combination as defined in claim 5 wherein said outlet end of said flow tube includes a pressurized air emitting opening having a cross sectional diameter smaller than the internal diameter of said flow tube so that the velocity of the pressurized air is increased as it is emitted outwardly from said flow tube.

7. In the combination as defined in claim 4 wherein the inner diameter of said sleeve is only somewhat greater than the outside diameter of said flow tube and wherein said flow tube is concentrically positioned within said sleeve, whereby a surrounding air passage is formed between the outer wall of said flow tube and the inner wall of said sleeve.

8. In the combination as defined in claim 7 wherein said sleeve further includes auxiliary exhaust apertures communicating with said surrounding air passage and positioned rearwardly of said earlier recited exhaust apertures so as to aid in releasing pressurized air in the event of blockage or obstruction of said discharge end.

9. In an air gun adapted to provide a high pressure jet of compressed air for cleaning and characterized by the ability to transmit the compressed air with negligible loss of air pressure, wherein there is provided a portable valve body having air inlet means adapted to be connected to a source of pressurized air and for admitting pressurized air to said body and having air outlet means including an air outlet chamber opening outwardly from said body for egress of the pressurized air from said body, a valve carried by said body and being operably disposed between said inlet means and said outlet means, and means mounted on said body for manual actuation of said valve so as to selectively control the flow of pressurized air out of said body, the combination therewith of an elongate flow tube outwardly extending from said valve body and having substantially uniform outside and inside diameters and including open inlet and outlet ends, said inlet end being outwardly flared and received in said air outlet chamber so as to be in communication with said air outlet means for receiving pressurized air therefrom and said outlet end having an outwardly directed opening for emitting pressurized air in a concentrated stream from said air gun; and a sleeve positioned in a surrounding relation to said flow tube and having a first end threadably mounted within said air outlet chamber, said first end including a shoulder against which said flared inlet end is supported when pressurized air is passed through said flow tube, said sleeve also having a second end serving as a discharge end and extending beyond said outlet end of said flow tube and terminating closely adjacent thereto so as to serve to protect against blockage or stoppage of said outlet end, said sleeve including exhaust apertures communicating with the interior of said sleeve and closely adjacent said outlet end of said flow tube so that under normal operating conditions no material reduction in air pressure between said air inlet means and said discharge end is effected, but in the event said discharge end is blocked or obstructed, pressurized air is released through said apertures.

10. In the combination as defined in claim 9 wherein said exhaust apertures are angularly oriented with respect to the length of said sleeve so that when pressurized air is released through said apertures the air is directed rearwardly and away from the discharge end of said sleeve.

11. In the combination as defined in claim 10 wherein said sleeve further includes auxiliary exhaust apertures communicating with the interior of said sleeve and positioned thereon rearwardly of said earlier recited exhaust apertures and circumferentially in spaced relation around said sleeve, whereby the release of pressurized air from said sleeve in the event of blockage or obstruction of said discharge end is facilitated.

12. In the combination as defined in claim 11 wherein each of said flow tube and said sleeve is about 5 inches in length and each being substantially less than 1 inch in diameter so as to provide a flow tube and sleeve having long and slender proportions capable of extending into narrow or restricted areas for cleaning.

13. In the combination as defined in claim 12 wherein said sleeve and said flow tube are concentrically positioned so as to form a surrounding air passage of about 1/16 inch between the outer wall of said flow tube and the inner wall of said sleeve.

* * * * *